United States Patent [19]

Tsukamoto et al.

[11] 4,115,211

[45] Sep. 19, 1978

[54] PROCESS FOR METAL PLATING ON ALUMINUM AND ALUMINUM ALLOYS

[75] Inventors: Takeo Tsukamoto; Miyoshi Okamura; Toshio Kutami, all of Tokyo, Japan

[73] Assignee: Nihon Kagaku Sangyo Co., Ltd., Tokyo, Japan

[21] Appl. No.: 753,555

[22] Filed: Dec. 22, 1976

[30] Foreign Application Priority Data

Dec. 26, 1975 [JP] Japan ..... 50-154818

[51] Int. Cl.[2] ..... C25D 5/44; C25D 5/50

[52] U.S. Cl. ..... 204/37 R; 204/38 A; 204/42; 204/33

[58] Field of Search ..... 204/33, 37 R, 38 A, 204/40, 42

[56] References Cited

U.S. PATENT DOCUMENTS

| | | | |
|---|---|---|---|
| 2,578,400 | 12/1951 | Cohn | 204/42 |
| 2,637,686 | 5/1953 | McKay | 204/37 R |
| 2,965,551 | 12/1960 | Richaud | 204/38 A |
| 2,970,090 | 1/1961 | Withers et al. | 204/40 |
| 3,468,765 | 9/1969 | McConnell | 204/33 |
| 3,493,474 | 2/1970 | Weber et al. | 204/33 |
| 3,531,379 | 9/1970 | Peach | 204/33 |
| 3,717,555 | 2/1973 | Chakravarti et al. | 204/35 N |

*Primary Examiner*—John H. Mack
*Assistant Examiner*—William Leader
*Attorney, Agent, or Firm*—Fleit & Jacobson

[57] ABSTRACT

Metal plated aluminum product with good adhesion between aluminum substrate and plated metal are found to be producible by the process which comprises: electrolyzing aluminum or aluminum alloys by A.C. or superimposed A.C. and D.C. in an electrolytic solution capable of producing a growth type or barrier type anodic oxide coating onto the surface of the aluminum or aluminum alloy and comprising an aqueous solution containing a water-soluble acid and a water-soluble heavy metal salt, thereby to impart good adhesion properties to the aluminum or aluminum alloy surface and render it suitable as a substrate for plating of additional metal thereon, metal plating on the resulting aluminum substrate, and subjecting said plated substrate to a heat treatment to enhance the adhesion between the substrate and the additional metal plated thereon.

14 Claims, No Drawings

PROCESS FOR METAL PLATING ON ALUMINUM AND ALUMINUM ALLOYS

DETAILED DESCRIPTION OF THE INVENTION

This invention relates to a process for metal plating with extremely good adhesion to an aluminum or aluminum alloy substrate, and more particularly, to a process for enhancing the adhesive property between an aluminum substrate and a plated metal by metal plating on aluminum and aluminum alloys, comprising: electrolyzing aluminum and aluminum alloys by A.C. or superimposed A.C. and D.C. in an electrolytic solution capable of producing a growth type or barrier type anodic oxide coating onto the surface of the aluminum or aluminum alloy and comprising an aqueous solution containing a water-soluble acid, such as sulfuric, phosphoric, sulfamic, boric, oxalic, tartaric, citric, malonic, and maleic acids, and a water-soluble salt of a heavy metal, such as zinc, antimony, cadmium, chromium, cobalt, tin, iron, copper, lead, nickel, bismuth, manganese, and molybdenum, thereby to impart good adhesion properties to the aluminum or aluminum alloy surface and render it suitable as a substrate for the plating of additional metal thereon, plating the resulting aluminum substrate with a metal such as copper, nickel, chromium and the like, and subjecting the resulting metal plated product to a heat treatment to enhance the adhesion between the substrate and the additional metal plated thereon.

Heretofore, it has been considered to be extremely difficult in metal plating to obtain a good adhesive property on the surface of aluminum and aluminum alloys, due to the existence in the passive state of an oxide coating on the aluminum or the like. Therefore, various processes, as described below, of treating the substrate prior to metal plating, have been developed to overcome the above problems.

These principal processes used currently can be generally classified into three types as follows: (1) chemical plating process, (2) anodized coating process, and (3) molten metal plating process.

Of these, the chemical plating process (1), also referred as zincate process, is a zinc displacement process, and is extensively practised as well-known in the art, although it is limited to the aluminum to be plated in its quality. Also, due to the insufficient adhesive property between the aluminum substrate and the plated metal, it cannot withstand the severe conditions of use.

The anodized coating process (2) could provide the usual adhesive property, but has the same problems of quality limitation regarding the aluminum substrate as the chemical plating process, and often manifests unsatisfactory results under severe performance tests. Consequently, this process has not been generally employed and is not popular.

The molten metal plating process (3) is a process for plating wherein a metal of low melting temperature, such as tin, zinc, lead, or the like, is heated until molten, and aluminum is immersed in the molten metal. In this process, the substrate aluminum would not be limited as to quality as in the chemical plating process and anodized coating process, and good adhesive property could be provided. However, the problems encounted in this process are the large amount of heat source needed and its inferiority to the former two processes in producing an aluminum material in an annealed and soft condition and which also presents a poor visual appearance.

The metal plating process of this invention is a new metal plating process on aluminum and aluminum alloys which overcomes the above defects in each of the above treating processes of plating on a substrate. A description of this process follows hereafter.

Heretofore, the effective action of an aluminum anodic oxide coating as a plating substrate was commonly considered to be caused by its porosity and pore size and therefore, phosphoric acid was mostly used as a electrolyte solution in the anodized coating process because larger pores are formed in an anodized coating when a phosphoric acid bath is used.

But recently, unlike the previous views, the so-called active center theory is receiving more attention. According to this theory, the effective action takes place at nuclear generation points of electrodeposited crystal at the defective point and the impurities in the anodic oxide coating. In fact, the inventors have found in their preliminary experiment that the anodic oxide coating free from pores acts effectively, but, notwithstanding either theory, this process provided insufficient adhesive property between the aluminum substrate and the plated metal, and was unsatisfactory in practical use.

However, the substrate treating method in the metal plating process of this invention, independently of the theory described above, provides an extremely enhanced adhesive property and comprises a process of substrate treating whereby metal is admixed as impurity in an exact amount, neither more nor less, to allow suitable metal plating, and additionally, copper plating, nickel plating, chromium plating and the like on an aluminum and and aluminum alloy substrate treated above, and thereafter subjecting the additionally plated substrate to a heat treatment.

More particularly, the process in accordance with the invention comprises electrolyzing aluminum and aluminum alloys by A.C. or superposed A.C. and D.C. in an electrolyte solution having dissolved therein a soluble salt of a metal such as zinc, antimony, cadmium, chromium, cobalt, tin, iron, copper, lead, nickel, bismuth, manganese, molybdenum or the like, and an acid such as oxalic, tartaric, citric, malonic, maleic, sulfuric, phosphoric, sulfamic, nitric acids or the like, metal plating the treated substrate with copper, nickel, chromiun, and the like, and thereafter subjecting the thus-plated substrate to a heat treatment to enhance the adhesion between the aluminum and the plated metal.

The enhanced adhesive property between the aluminum and the plated metal attained during the heat treatment step of metal plating on aluminum and aluminum alloys, is assumed to be caused by enough diffusion, between the aluminum and the plated metal during the heat treatment, of the impurity admixed in the anodic oxide coating formed during the surface treatment of plating the substrate.

The following examples are representative of the metal plating process in accordance with the invention.

EXAMPLE 1

A solution was prepared by dissolving 10 g/l of sodium oxalate in water followed by the addition of 10 g/l of copper oxalate and 50 g/l of oxalic acid. Using this solution as an electrolytic solution and a copper plate as a counter electrode, aluminum plate, JIS 1100, was electrolyzed by A.C. for about 30 minutes at 20° C. and a current density of 3.0 A/dm$^2$. The resulting aluminum piece was copper plated in a normal copper pyrophosphate plating bath for about 45 minutes. The copper plated aluminum piece was subjected to heat treatment at 150° C. for 30 minutes, and, after removing rusts with 10% sulfuric acid, was nickel plated for about 45 minutes in a normal "Watts" bath and additionally chromium plated for 2 minutes in normal "Sargent" bath.

EXAMPLE 2

A solution was prepared by dissolving 100 g/l of tartaric acid in water followed by the addition of 10 g/l of tin sulfate. Using this solution as an electrolyte solution and a carbon plate as a counter electrode, aluminum plate, JIS 1100, was electrolysed by A.C. for about 30 minutes at 20° C and a current density of 3.0 A/dm$^2$. The resulting aluminum piece was copper plated in a normal copper pyrophosphate plating bath for about 45 minutes. The resulting specimen was then nickel plated in a normal "Watts" bath for about 45 minutes and additionally chromium plated in a normal "Sargent" bath for 2 minutes. The above plated aluminum specimen was then subjected to a heat treatment at 200° C for 30 minutes.

EXAMPLE 3

A solution was prepared by dissolving 150 g/l of malonic acid in water followed by the addition of 5 g/l of copper sulfate. Using this solution as an electrolyte solution and a copper plate as a counter electrode, aluminum extruded shape, JIS 6063, was electrolyzed by superposed A.C. and D.C. for about 5 minutes at 20° C and a current density of A.C. 1.5 A/dm$^2$ and D.C. 1.0 A/dm$^2$. The resulting aluminum piece was copper plated in a normal copper pyrophosphate plating bath for about 45 minutes. The copper plated aluminum piece was then subjected to a heat treatment at 200° C for 30 minutes, and, after removing rusts with 10% sulfuric acid, was nickel plated in a normal "Watts" bath for about 45 minutes, and then chromium plated in a normal "Sargent" bath for 2 minutes.

EXAMPLE 4

A solution was prepared by dissolving 200 g/l of phosphoric acid in water followed by the addition of 10 g/l of zinc sulfate. Using this solution as an electrolyte solution and a carbon plate as a counter electrode, aluminum die casting alloy, JIS ADC-10, was electrolyzed by A.C. for about 10 minutes at 20° C and a current density of 2.0 A/dm$^2$. The resulting piece was copper plated in a normal copper pyrophosphate plating bath for about 45 minutes. The resulting specimen was then nickel plated in a normal "Watts" bath for about 45 minutes and then additionally chromium plated in a normal "Sargent" bath for 2 minutes. The metal plated aluminum specimen was then subjected to a heat treatment at 200° C for 1 hour.

EXAMPLE 5

A solution was prepared by dissolving 200 g/l of sulfuric acid in water followed by the addition of 5 g/l of copper sulfate. Using this solution as an electrolyte solution and a copper plate as a counter electrode, aluminum plate, JIS 1100, was electrolyzed by superimposed A.C. and D.C. for about 20 minutes at 20° C, and a current density of A.C. 1.5 A/dm$^2$ and D.C. 1.0 A/dm$^2$. The resulting aluminum specimen was nickel plated in a normal "Watts" bath for about 45 minutes then subjected to a heat treatment at 200° C for 30 minutes, and, after removing the rust with 10% hydrochloric acid, was chromium plated in a normal "Sargent" bath for 2 minutes.

EXAMPLE 6

A solution was prepared by dissolving 150 g/l of sulfamic acid in water followed by the addition of 10 g/l of nickel sulfamate. Using this solution as an electrolyte solution and a carbon plate as a counter electrode, aluminum plate, JIS 1100, was electrolyzed by A.C. for about 10 minutes at 20° C and a current density of 1.5 A/dm$^2$. This aluminum specimen was then nickel plated in a normal "Watts" bath for about 45 minutes and then additionally chromium plated in a normal "Sargent" bath for 2 minutes. The metal plated aluminum specimen was then subjected to a heat treatment at 250° C for 1 hour.

EXAMPLE 7

A solution was prepared by dissolving 20 g/l of boric acid in water followed by the addition of 5 g/l of tin sulfate. Using this solution as an electrolyte solution and a carbon plate as a counter electrode, aluminum extruded shape, JIS 6063, was electrolyzed by A.C. for about 10 minutes at 20° C and a current density of 1.0 A/dm$^2$. This alumimum piece was copper plated in a normal copper pyrophosphate plating bath for about 45 minutes. The resulting specimen was then nickel plated in normal "Watts" bath for about 45 minutes and then chromium plated in a normal "Sargent" bath for about 2 minutes. The thus metal plated specimen was then subjected to a heat treatment at 200° C for 1 hour.

The metal plated aluminum product pieces obtained in the above examples were heated with a gas burner at the temperature of 300° to 350° C and quenched with water at 20° C. On observing the surface of the above treated pieces, no anomalous appearance could be found of blisters, peelings, and the like. In a test of another product in which pieces of such type were subjected to bending to 180°, no abnormal defect could be observed in their sections and no peeling was seen. Also, in the CASS test and the corrodkote test, an accelerated corrosion test, other product pieces of such type remained without any abnormal defect until proceeding the end of 4 cycles.

In addition, aluminums with a quality of JIS 3003, 5005, 5052, 6061, 7075 were metal plated in a similar process, and similar results were observed after testing. Further, similar results were obtained in the case of using citric acid or maleic acid as an electrolyte solution, and similar results were obtained in the same tests as to the product treated with a soluble salt of a metal such as antimony, cadmium, chromium, cobalt, iron, lead, bismuth, manganese, molybdenum or the like used in an electrolyte solution as a dissolved metallic salt.

The conditions and bath compositions of copper plating, nickel plating and chromium plating are given in the following table.

| Copper Plating | | Nickel Plating | | Chromium Plating | |
|---|---|---|---|---|---|
| Copper pyrophosphate | 85 g/l | Nickel sulfate | 309 g/l | Chromic anhydride | 250 0 g/l |
| Potassium pyrophosphate | 350 g/l | Nickel chloride | 45 g/l | Sulfuric acid | 2.5 g/l |
| Poly phosphoric acid | 4 g/l | Boric acid | 30 g/l | | |
| Aqueous ammonia | 3 g/l | | | | |

-continued

| Copper Plating | | Nickel Plating | | Chromium Plating | |
|---|---|---|---|---|---|
| Current density | 3 A/dm$^2$ | Current density | 3 A/dm$^2$ | Current density | 20 A/dm$^2$ |
| Temperature | 55° C | Temperature | 50° C | Temperature | 45° C |

The metal plating process on aluminum and aluminum alloys in accordance with this invention comprises, as described above, electrolyzing aluminum and aluminum alloys by A.C. or superimposed A.C. and D.C. in an electrolyte solution comprising an aqueous solution having dissolved therein a soluble salt of a heavy metal such as zinc, antimony, cadmium, chromium, cobalt, tin, iron, copper, lead, nickel, bismuth, manganese, molybdenum or the like, and an acid such as oxalic, tartaric, citric, malonic, maleic, sulfuric, phosphoric, sulfamic, boric acids or the like, metal plating on the resulting substrate with metals such as copper, nickel, chromium and the like, and then subjecting the thus plated substrate to a heat treatment to provide extremely enhanced adhesion between the aluminum and the plated metal. Because the metal plating process of the invention is less limited in substrate quality of aluminum compared with conventional processes, aluminum material of any quality may be metal plated and afford not merely enhanced adhesive property but also be effective in improving corrosion resistance property.

We claim:

1. A process for the electrodeposition of metal on an aluminum or aluminum alloy substrate comprising:

(a) electrolyzing aluminum or an aluminum alloy by A.C. or superimposed A.C. and D.C., the aluminum or aluminum alloy being connected as the anode with respect to the D.C. component superimposed on the A.C., in an electrolytic solution comprising an aqueous solution containing a water-soluble acid and a water-soluble salt of a heavy metal, at a temperature of about 20° C for about from 5 to 30 minutes, thereby to produce an anodic oxide coating of said heavy metal onto the surface of the aluminum or aluminum alloy so as to impart good adhesion properties to the aluminum or aluminum alloy and render it suitable as a substrate for the electrodeposition of additional metal thereon;

(b) electrodepositing at least one additional metal on the thus-electrolyzed aluminum or aluminum alloy substrate; and (c) heating the resulting aluminum or aluminum alloy substrate carrying the electrodeposited additional metal thereon to enhance the adhesion between the substrate and the additional metal.

2. The process of claim 1 wherein the A.C. has a current density ranging about from 1.0 to 3.0 amperes per square decimeter.

3. The process of claim 1 wherein the superimposed A.C. and D.C. has a current density of about 1.5 amperes per square decimeter of A.C. and about 1.0 ampere per square decimeter of D.C.

4. The process of claim 1 wherein the water-soluble acid is a member selected from the group consisting of oxalic, tartaric, citric, malonic, maleic, sulfuric, phosphoric, sulfamic, and boric acids.

5. The process of claim 1 wherein the water-soluble acid is employed in an amount ranging about from 20 to 200 grams per liter.

6. The process of claim 1 wherein the heavy metal of the water-soluble salt is a member selected from the group consisting of zinc, antimony, cadmium, chromium, cobalt, tin, iron, copper, lead, nickel, bismuth, manganese, and molybdenum.

7. The process of claim 1 wherein the watersoluble salt of the heavy metal is employed in an amount ranging about from 5 to 10 grams per liter.

8. The process of claim 1 wherein the additional metal electrodeposited on the electrolyzed substrate is at least one member selected from the group consisting of copper, nickel, and chromium.

9. The process of claim 8 wherein copper, nickel, and chromium as the additional metals are consecutively electrodeposited on the electrolyzed substrate.

10. The process of claim 8 wherein nickel and chromium as the additional metals are consecutively electrodeposited on the electrolyzed substrate.

11. The process of claim 1 wherein the heating of the substrate carrying the electrodeposited additional metal thereon to enhance the adhesion between the substrate and the additional metal is carried out at a temperature ranging about from 150° C to 250° C for about from 30 to 60 minutes.

12. A process for the electrodeposition of a metal on an aluminum or aluminum alloy substrate comprising:

(a) electrolyzing aluminum or an aluminum alloy by A.C. having a current density ranging about from 1.0 to 3.0 amperes per square decimeter or by superimposed A.C. and D.C. having a current density of about 1.5 amperes per square decimeter of A.C. and about 1.0 ampere per square decimeter of D.C., the aluminum or aluminum alloy being connected as the anode with respect to the D.C. component superimposed on the A.C., in an electrolytic solution comprising an aqueous solution containing about from 20 to 200 grams per liter of a water-soluble acid selected from the group consisting of oxalic, tartaric, citric, malonic, maleic, sulfuric, phosphoric, sulfamic, and boric acids, and about from 5 to 10 grams per liter of a water-soluble salt of a heavy metal selected from the group consisting of zinc, antimony, cadmium, chromium, cobalt, tin, iron, copper, lead, nickel, bismuth, manganese, and molybdenum, at a temperature of about 20° C for about from 5 to 30 minutes, thereby to produce an anodic oxide coating of said heavy metal onto the surface of the aluminum or aluminum alloy so as to impart good adhesion properties to the aluminum or aluminum alloy and render it suitable as a substrate for the electrodeposition of additional metal thereon;

(b) electrodepositing at least one additional metal selected from the group consisting of copper, nickel, and chromium on the thus-electrolyzed aluminum or aluminum alloy substrate; and (c) heating the resulting aluminum or aluminum alloy substrate carrying the electrodeposited additional metal thereon at a temperature ranging about from 150° C to 250° C for about from 30 to 60 minutes to enhance the adhesion between the substrate and the additional metal electrodeposited thereon.

13. The process of claim 12 wherein copper, nickel, and chromium as the additional metals are consecutively electrodeposited on the electrolyzed substrate.

14. The process of claim 12 wherein nickel and chromium as the additional metals are consecutively electrodeposited on the electrolyzed substrate.

* * * * *